United States Patent [19]

Jackson

[11] 4,275,928

[45] Jun. 30, 1981

[54] PLANING APPARATUS WITH BRIDGING CUTTERS

[75] Inventor: Philip Jackson, Chesterfield, England

[73] Assignee: Errut Products Limited, London, England

[21] Appl. No.: 68,760

[22] Filed: Aug. 23, 1979

[30] Foreign Application Priority Data

Aug. 25, 1978 [GB] United Kingdom ..... 34604/78
Feb. 7, 1979 [GB] United Kingdom ..... 4259/79

[51] Int. Cl.[3] ..... E01C 23/09

[52] U.S. Cl. ..... 299/39; 299/86; 175/338

[58] Field of Search ..... 299/39, 40, 86; 175/338

[56] References Cited

U.S. PATENT DOCUMENTS

| | | | |
|---|---|---|---|
| 1,084,810 | 1/1914 | Messer | 299/39 |
| 1,791,865 | 2/1931 | Fordyce | 299/39 |
| 1,964,746 | 7/1934 | Sloan | 299/39 |
| 2,014,186 | 9/1935 | Myers | 299/39 |
| 3,266,846 | 8/1966 | Luksch et al. | 299/39 |
| 3,695,722 | 10/1972 | Fairwether et al. | 299/39 |
| 3,695,723 | 10/1972 | Kita et al. | 299/40 |

*Primary Examiner*—Ernest R. Purser
*Attorney, Agent, or Firm*—Irving M. Weiner; Pamela S. Burt; John L. Shortley

[57] ABSTRACT

Planing apparatus is disclosed having a rotatable cutting drum comprising a central, rotatable support, a plurality of secondary supports spaced around the central support and in parallel relationship thereto, and a plurality of apertured cutting members mounted on each secondary support and axially spaced apart. The spaces between the cutting members on one of the secondary supports is bridged or almost bridged when viewed in a direction normal to the axis of the drum by the cutting members on one or more of the other secondary supports. The drum is housed for rotation in a base structure having rear wheels and front wheels which can be displaced vertically to adjust the depth to which a surface, e.g. a road surface, is to be planed. The drum and wheels are driven by a motor supported on the base structure. Various different types of cutting members are disclosed.

22 Claims, 11 Drawing Figures

PLANING APPARATUS WITH BRIDGING CUTTERS

Figure 1:
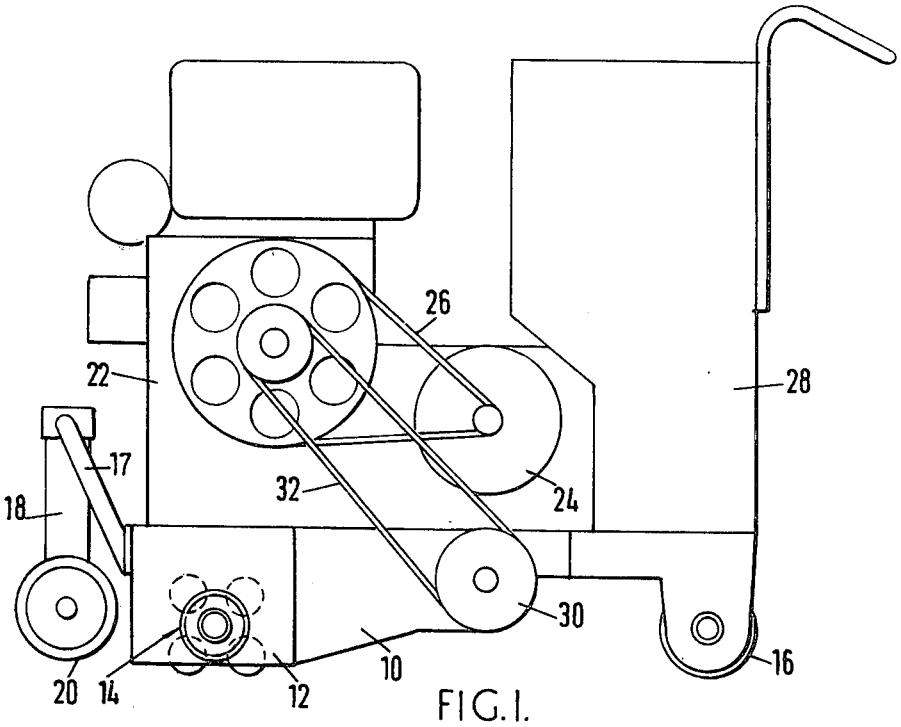

This invention relates to planing apparatus and particularly, but not exclusively to such apparatus for planing road surfaces.

According to the invention there is provided planning apparatus having a rotatable cutting drum comprising a central, rotatable support, a plurality of secondary supports spaced around the central support and in parallel relationship thereto, and a plurality of apertured cutting members mounted on each secondary support and axially spaced apart, the spaces between the cutting members on one of the secondary supports being bridged or almost bridged when viewed in a direction normal to the axis of the drum by the cutting members on one or more of the other secondary supports.

Preferably, the secondary supports are spaced equidistantly from the central support.

Preferably, the secondary supports are equi-angularly spaced around the central support.

Preferably, the cutting members are spaced by spacer elements, the width of the cutting members in an axial direction being substantially equal to the width of the spacer elements. In this case, there are, advantageously, an even number of, and at least four, secondary supports, and the cutting members of angular adjacent secondary supports are staggered axially with respect to each other so that the spaces between the cutting members on each secondary support when viewed in a direction normal to the axis of the drum are bridged or almost bridged by the cutting members on each of the two angularly adjacent secondary supports.

Preferably, the secondary supports are supported by arms secured to the central support and extending radially therefrom.

Preferably, the apparatus has at least two axles, one of which carries at least one ground wheel and the other of which carries at least two ground wheels, means for effecting rotation of the cutting drum and means for effecting rotation of at least one of said axles for causing the apparatus to move along a surface to be planed in a direction normal or substantially normal to the axis of rotation of the cutting drum.

Preferably, means (e.g. fluid pressure operated means) are provided for effecting relative vertical displacement of the cutting drum and one of the axles.

Preferably, the apparatus has a suction fan connected to a dust collector for sucking up dust formed during planing of a surface.

Advantageously, the cutting members each have a plurality of angularly spaced cutting tips and are mounted for angular movement on the secondary support.

Preferably, the cutting tips are equi-angularly spaced about and arranged to be equi-distant from an associated secondary support.

Conveniently, each cutting member comprises a substantially disc-shaped body having a plurality of angularly spaced recesses in the circumference thereof, and a cutting tip mounted in each recess. Preferably, the recesses are part circular and each cutting tip is circular, when viewed in the direction of the axis of the body.

Preferably, the wall of each recess describes more than a semi-circle.

Preferably, the body has between each pair of adjacent cutting tips, a radially inwardly directed depression.

Preferably, the volume occupied by the depression on the leading edge side of a plane bisecting the angle between adjacent tips is less than the volume occupied by the depression on the trailing edge side of the plane.

Preferably, the width of each cutting tip is greater or equal to the width of the body, when viewed in a direction normal to the axis of the body.

Alternatively, the cutting members each comprise an elongated plate having a cutting tip mounted in a recess at one end of the plate, and an elongated aperture axially aligned with the cutting tip and arranged so that the centre of gravity of the plate is between the aperture and the tip, the plate having a leading edge and trailing edge each of which has an end portion tapering inwardly and downwardly to the cutting tip, the taper of the leading edge end portion being steeper than the taper of the trailing edge and portion.

Conveniently, the cutting tips are formed of tungsten carbide and are secured in the recesses by blazing.

Figure 2:
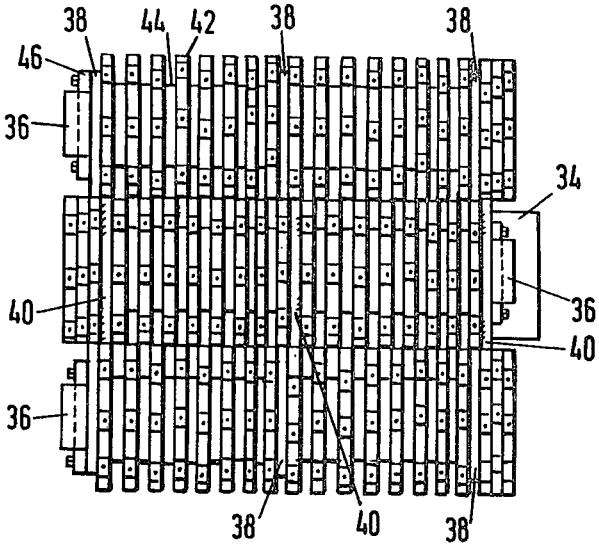
Figure 3:
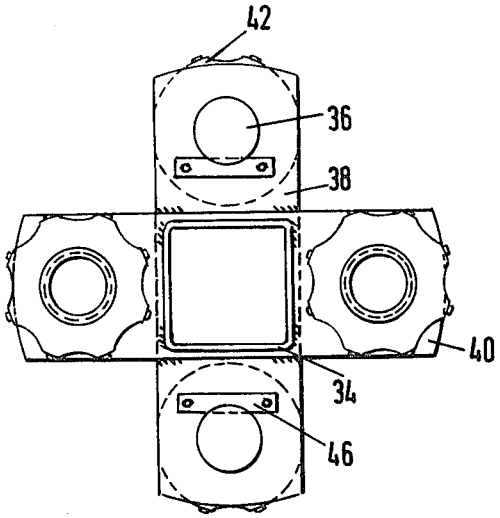
Figure 4:
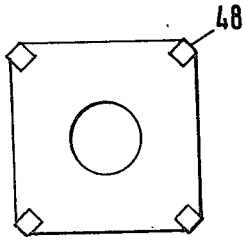
Figure 6:
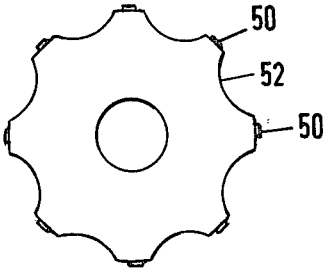
Figure 5:
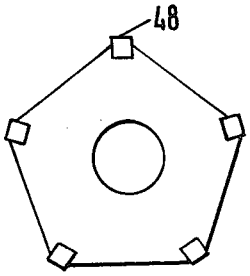
Figure 7:
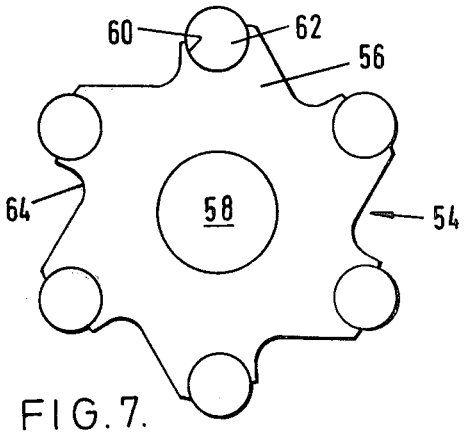
Figure 8:
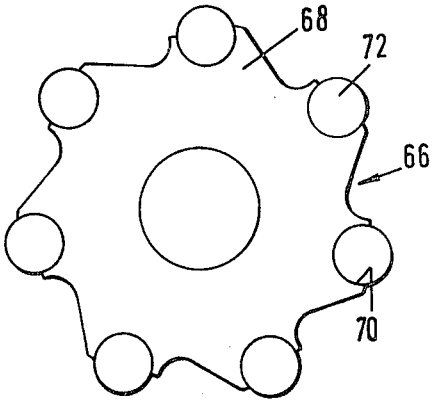
Figure 9:
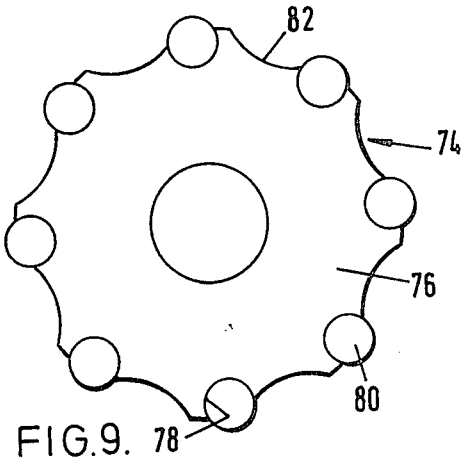
Figure 10:
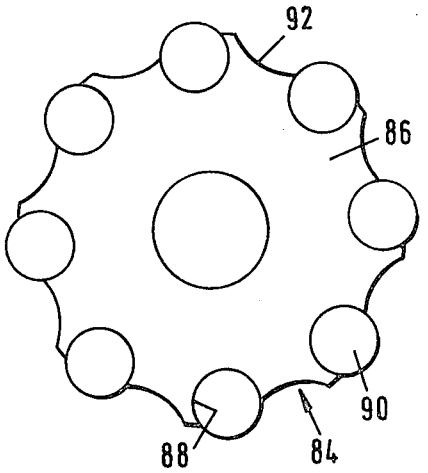
Figure 11:
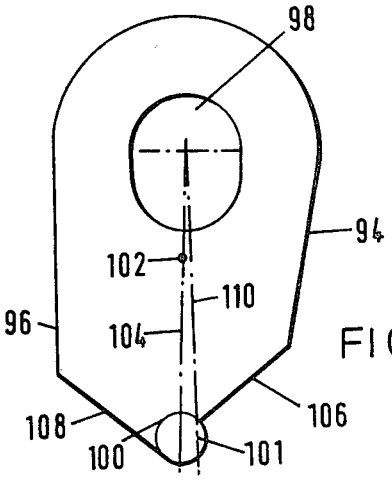

The invention will now be more particularly described with reference to the accompanying drawings, wherein:

FIG. 1 is a side view of one embodiment of apparatus according to the invention, FIG. 2 is a plan view of the rotatable cutting drum shown in FIG. 1 and angularly displaced by 45°, FIG. 3 is an end view of the drum shown in FIG. 2, FIGS. 4–6 illustrate various examples of cutting members, the example shown in FIG. 5 also being illustrated in FIGS. 2 and 3, FIG. 7 is a side view of a cutting member having six cutting tips, FIGS. 8–10 are similar views of different cutting members having respectively seven, eight and nine cutting tips, and FIG. 11 is a side view of another cutting member.

Referring to FIG. 1 of the drawings; the planing apparatus shown therein comprises a base structure 10 incorporating a housing 12 for a rotatable, cutting drum 14. The base structure 10 carries rear, driven wheels 16 and the forward end of the base structure 10 has secured thereto a forwardly and upwardly extending support bracket 16, the upper forward end of which is connected to the upper end of a cylinder of an hydraulic piston and cylinder unit 17. The piston rod of the unit 18 carries front wheels 20 which can be displaced in a vertical direction by the unit 18. The base structure 10 supports a motor 22 which may, for example, be petrol, diesel or electrically powered. The base structure 10 also carried a fan 24, which is driven by the motor 22 via a belt 26, and a dust collector 28. A lay shaft 30 is driven by the motor 22 via a belt 32. The rear wheels 16 are driven by the lay shaft 30 via a further belt (not shown) and an infinitely-variable hydraulic transmission unit (not shown).

The rotatable cutting drum 14 has a central, rotatable support 34 (see FIGS. 2 and 3) which is non-circular and preferably square, when viewed in an axial direction, and is slidably mounted on a rotatable shaft having a portion between its ends of matching non-circular configuration and at each end right cylindrical portions, which are journalled for rotation in bearings provided in opposite sides of the housing 12. The shaft mounting the cutting drum is driven in an anti-clockwise direction (as viewed in FIG. 1) by the lay shaft 30 via yet a further belt (not shown) and one of the bearing supporting sides of the housing 12 is easily removable to provide ready access to the cutting drum.

In addition to the central support 34, the cutting drum also comprises four secondary support shafts 36 spaced equi-distantly from, in parallel relationship to and equi-angularly spaced around the central support 34. The shafts 36 are carried by three pairs of arms, the two arms 38 and 40 of each pair being secured, such as by welding, to the central support 30 and extending in mutually perpendicular directions. Each arm 38, 40 projects from the central support 34 in opposite directions and has an aperture adjacent each end through which one of the shafts 36 extends. Two of the pairs of arms are respectively secured to the central support 34 adjacent opposite ends thereof and the third pair of arms is secured to the central support 34 between the ends thereof, the three pairs of arms being angularly aligned, when viewed in an axial direction.

Each shaft 36 carries a plurality of rotatable cutting members 42 and annular spacing elements 44.

The width of the cutting members 42, the spacing elements 44 and the arms 38 and 40 in an axial direction are equal or substantially equal for a reason which will become apparent later.

The assembly of cutting members 42 and spacing elements 44 on one of the shafts 36 will be described with reference, by way of example, to the uppermost shaft 36 shown in FIG. 2. The cutting member shown at the extreme righthand end of the shaft has a counter-bored aperture for receiving an outwardly flared integral portion (not shown) at the extreme righthand end of the shaft 36 and this cutting member is mounted on the shaft 36 from the lefthand end thereof. Two further cutting members 42 are then mounted on the shaft 36, whereafter the shaft is inserted through its associated aperture in the extreme righthand arm 38. Further cutting members 42 are alternately mounted on the shaft 36 with spacing elements 44 until the cutting members and spacing elements bridge the gap between the righthand and central arm 38. The shaft 36 is then inserted through its associated aperture in the central arm 38 and further cutting members are alternately mounted on the shaft 36 with further spacing elements 44 until the cutting members and spacing elements bridge the gap between the central and lefthand arms 38. The shaft 36 is then inserted through its associated aperture in the lefthand arm 38. The lefthand end of the shaft 36 has a segmental groove in which is inserted a bar 46 which is subsequently secured to the lefthand arm 38 by bolts or the like for locating the shaft 36 against axial movement.

The lowermost shaft 36, as shown in FIG. 2, is assembled in a similar manner, but the other two shafts are axially inverted, the cutting members and spacing elements being mounted on these other shafts from the righthand end.

As a result of this, it will be seen from FIG. 2 that the cutting members 42 of angularly adjacent secondary support shafts 36 are staggered axially with respect to each other so that the spaces between the cutting members on each secondary support shaft, when viewed in a direction normal to the axis of the cutting drum are bridged or almost bridged by the cutting members on each of the two angularly adjacent secondary support shafts.

FIGS. 4–8 show typical examples of cutting members which may be used in the above-described apparatus. The cutting member shown in FIG. 4 has a central aperture, the diameter of which is slightly greater than the diameter of the secondary support shafts 36. When viewed in an axial direction the cutting member is generally square in configuration having at each corner a diagonally directed recess into which a cutting tip 48, which may, for example, be of tungsten carbide, is inserted and secured to the walls of the recess by brazing or the like.

The cutting member shown in FIG. 5 is similar to the cutting member shown in FIG. 4, but is, when viewed in an axial direction, of pentagonal configuration having sides of equal length and cutting tips at each corner.

The cutting member shown in FIG. 6 also has a central aperture the diameter of which is slightly larger than the diameter of the secondary support shafts 36. When viewed in an axial direction, this cutting member is of generally circular configuration having eight equi-angularly spaced holes formed in the periphery thereof and in each of which is inserted a cutting tip 50 of circular cross-section. Each cutting tip may be retained as a tight-push fit in its associated hole or may be secured therein, such as by brazing. This cutting member also has a concave cut-away portion 52 between adjacent cutting tips 50.

The cutting member 54 shown in FIG. 7 comprises a disc-shaped body 56 having therein a central aperture 58 through which a secondary support of the planing apparatus extends and about which the body 56 may rotate. The body 56 also has six equi-angularly spaced recessed 60 in the circumference thereof, the recesses being part-circular when viewed in the direction of the axis of the body.

Secured in each recess, such as by brazing, is a tungsten carbide cutting tip 62 which is circular when viewed in the aforesaid axial direction. As shown, the recesses 60 each describe more than a semi-circle, the cutting tips 62 being inserted into the recesses 60 by moving the tips and body relative to each other in a direction parallel to the axis of the body 56. Since, each recess describes more than a semi-circle, the walls of the recesses 60 restrain the cutting tips 62 therein against the influence of centrifugal force.

The width of each cutting tip 62 is at least equal to and may be greater than the width of the body 56 when viewed in a direction normal to the axis of the body.

The body 56 may, for example, be formed from a nickel-chrome steel.

The centres of the circular cutting tips 62 all lie on a circle, the centre of which is coincident with the axis about which the body 56 is rotatable.

The body 56 has between each pair of adjacent cutting tips 62, a radially inwardly directed depression 64. It is intended to mount the cutting member 54, on a secondary support of the cutting drum 14 which is rotatable in an anti-clockwise direction. As shown in FIG. 7, the volume occupied by each depression 64 on the leading edge side (or in other words, that side of the depression remote from the next cutting tip to come into contact with the surface being planed), of a plane bisecting the angle between adjacent cutting tips is less than the volume of the depression on the trailing edge side (or that side of the depression adjacent to the next cutting tip to come into contact with the surface being planed) of the plane. This is achieved, as shown in FIG. 7, by spacing the leading edge of each depression 64 further from an adjacent cutting tip 62 than the spacing between the trailing edge of the depression 64 and the next cutting tip 62 and by gently sloping the depression 64 towards a position of maximum depth which is located clockwise of the aforesaid plane and then more steeply inclining the wall of the depression towards the trailing edge thereof. Thus, each cutting tip has more material behind it than in front of it and this helps to support each cutting tip as it strikes the surface to be planed.

The cutting member 66 of FIG. 8 is similar to the cutting member 54 of FIG. 7, but the body 68 thereof has seven equi-angularly spaced recesses 70 in the circumference thereof, each recess 70 having secured therein a cutting tip 72.

The cutting members 74 and 84 shown in FIGS. 9 and 10 respectively are similar to each other but the body 76 carries eight cutting tips 80 secured in eight equi-angularly spaced recesses 78, whereas the cutting member 84 has nine cutting tips 90 secured in nine equi-angularly spaced recesses 88 formed in the circumference of the body 86. The cutting members 74 and 84 also differ from the cutting members 54 and 66 in that the depressions 82 and 92 formed respectively therein are each part circular when viewed in the direction of the axis of the respective body 76, 86, the leading edge of each depression 82, 92 being spaced from an adjacent cutting element 80, 90 whilst the trailing edge of each depression 82, 92 coincides with an adjacent cutting tip 80, 90 and is radially inwardly disposed with respect to the leading edge. However, once again, each cutting tip 80, 90 has more material behind it than in front of it and this again helps to support the cutting tip om impact with the surface to be planed.

With reference to FIGS. 7-10, it is to be understood that each cutting tip may be of other than circular shape, such as, for example, of oval shape when viewed in the direction of the axis of the body. In this case the recesses will be of matching shape.

Referring to FIG. 11, the cutting member shown therein is plate-shaped and has a leading edge 94, a trailing edge 96 and a longitudinal slot 98, the width of which is slightly greater than the diameter of the secondary shafts 36. However, the length of the slot 98 is considerably greater than the diameter of the secondary shafts 36 so as to provide for a prolonged impact of the cutting member on the surface being planed. The lower end of the cutting member has a recess 100 in which a cutting tip 101 (e.g. of tungsten carbide) is secured (such as by brazing). The centre of gravity 102 of the cutting member lies below the slot 98 on the longitudinal axis 104 of the cutting member. The lower end of the cutting member is tapered, the angle of the leading edge taper 106 being steeper than the angle of trailing edge 108. As a result the axis of impact 100 of the cutting member is slightly forwards of the longitudinal axis 104.

Returning to FIG. 1, operation of the hydraulic piston and cylinder unit 18 causes the front wheels 20 to move upwardly or downwardly, thereby vertically displacing the rotatable drum 14 and thus adjusting the depth to which, for example, a road surface, is to pe planed. The fan 24 is mounted upstream of the dust collector 28 and dust thrown up by the rotating cutting drum 14 as the cutting member strike the road surface is sucked up by the fan 24 into the dust collector 28.

It has been found that a single pass of the above apparatus will plane that portion of the road surface over which it passes to a depth substantially greater than the distance between the outer edges of the cutting members 42 and the outer edges of the arms 38 and 40.

As described above each shaft carries a plurality of independently rotatable cutting members 42 and annular spacing elements 44, but it is within the scope of the invention for some, if not all, cutting members mounted on each shaft to be integrally formed with each other and with their associated spacing elements.

I claim:

1. Planing apparatus having a rotatable drum which comprises:
   - a central rotatable support;
   - a plurality of secondary supports spaced around the central support;
   - a plurality of support members extending radially from the central support and supporting the secondary supports in parallel relationship to the central support;
   - a plurality of cutting members mounted on each secondary support;
   - means axially spacing apart at least some of the cutting members on each secondary support;
   - the spaces between the cutting members on one of the secondary supports being bridged or almost bridged when viewed in a direction normal to the axis of the drum by the cutting members on one or more of the other secondary supports; and
   - each radially extending support member being bridged or almost bridged when viewed in a direction normal to the axis of the drum by at least one cutting member on one or more of the other secondary supports so that the depth to which the apparatus can plane is not limited to the distance between the radially outermost part of a cutting member and the radially outermost edge of any of the radially extending support members.

2. Planing apparatus as claimed in claim 1, wherein the secondary supports are spaced equi-distantly from the central support.

3. Planing apparatus as claimed in claim 1, wherein the secondary supports are equi-angularly spaced around the central support.

4. Planing apparatus as claimed in claim 1, wherein the cutting members are spaced by spacer elements, the width of the cutting members in an axial direction being substantially equal to the width of the spacer elements.

5. Planing apparatus as claimed in claim 4, wherein there are an even number of, and at least four secondary supports and the cutting members of angularly adjacent secondary supports are staggered axially with respect to each other so that the spaces between the cutting members on each secondary support when viewed in a direction normal to the axis of the drum are bridged or almost bridged by the cutting members on each of the two angularly adjacent secondary supports.

6. Planing apparatus as claimed in claim 1, wherein there are an even number of, and at least four, secondary supports.

7. Planing apparatus as claimed in claim 1, further comprising at least two axles, one of which carries at least one ground wheel and the other of which carries at least two ground wheels, means for effecting rotation of the cutting drum and means for effecting rotation of at least one of said axles for causing the apparatus to move along a surface to be planed in a direction normal or substantially normal to the axis of rotation of the cutting drum.

8. Planing apparatus as claimed in claim 7, wherein means are provided for effecting relative vertical displacement of the cutting drum and one of the axles.

9. Planing apparatus as claimed in claim 8, wherein said displacement means comprises fluid pressure operated means.

10. Planing apparatus as claimed in claim 1, further comprising a suction fan connected to a dust collector for sucking up dust formed during planing of a surface.

11. Planing apparatus as claimed in claim 1, wherein the cutting members each comprise an elongated plate having a cutting tip mounted in a recess at one end of the plate, and an elongated aperture axially aligned with the cutting tip and arranged so that the centre of gravity of the plate is between the aperture and the tip, the plate having a leading edge and trailing edge each of which has an end portion tapering inwardly and downwardly to the cutting tip, the taper of the leading edge end portion being steeper than the taper of the trailing edge end portion.

12. Planing apparatus as claimed in claim 1, wherein:

each support member is spaced along said central rotatable support with respect to at least one support member and in alignment perpendicularly of said central support with a cutting member.

13. Planing apparatus as claimed in claim 1, wherein the cutting members each have a plurality of angularly spaced cutting tips and are mounted for angular movement on the secondary supports.

14. Planing apparatus as claimed in claim 13, wherein the cutting tips are formed of tungsten carbide.

15. Planing apparatus as claimed in claim 13, wherein the cutting tips are equi-angularly spaced about and arranged to be equi-distant from an associated secondary support.

16. Planing apparatus as claimed in claim 13, wherein each cutting member comprises a substantially disc-shaped body having a plurality of angularly spaced recesses in the circumference thereof, and a cutting tip mounted in each recess.

17. Planing apparatus as claimed in claim 16, wherein the recesses are part circular and each cutting tip is circular, when viewed in the direction of the axis of the body.

18. Planing apparatus as claimed in claim 17, wherein the wall of each recess describes more than a semi-circle.

19. Planing apparatus as claimed in claim 16, wherein the body has between each pair of adjacent cutting tips, a radially inwardly directed depression.

20. Planing apparatus as claimed in claim 19, wherein the volume occupied by the depression on the leading edge side of a plane bisecting the angle between adjacent tips is less than the volume occupied by the depression on the trailing edge side of the depression.

21. Planing apparatus as claimed in claim 16, wherein the width of each cutting tip is greater or equal to the width of the body, when viewed in a direction normal to the axis of the body.

22. Planing apparatus as claimed in claim 16, wherein the cutting tips are secured in the recesses by brazing.

* * * * *